US006467707B1

(12) United States Patent
Williams, Jr.

(10) Patent No.: US 6,467,707 B1
(45) Date of Patent: Oct. 22, 2002

(54) CONTROL LOGIC FOR USE IN CONTROLLING GRINDING MILL SYSTEMS

(75) Inventor: Robert M. Williams, Jr., Ladue, MO (US)

(73) Assignee: Robert M. Williams, St. Louis, MO (US)

( * ) Notice: Subject to any disclaimer, the term of this patent is extended or adjusted under 35 U.S.C. 154(b) by 132 days.

(21) Appl. No.: 09/679,797

(22) Filed: Oct. 5, 2000

(51) Int. Cl.[7] ..... B02C 25/00

(52) U.S. Cl. ..... 241/18; 241/24.1; 241/33; 241/34; 241/47; 241/65

(58) Field of Search ..... 241/33, 34, 35, 241/36, 15, 18, 19, 24.1, 47, 65, 79.1

(56) References Cited

U.S. PATENT DOCUMENTS

| | | | | |
|---|---|---|---|---|
| 3,337,142 A | | 8/1967 | Williams | |
| 4,184,640 A | | 1/1980 | Williams | |
| 4,226,371 A | | 10/1980 | Williams | |
| 4,478,371 A | | 10/1984 | Williams | |
| 4,489,664 A | | 12/1984 | Williams | |
| 4,522,343 A | | 6/1985 | Williams | |
| 4,540,129 A | * | 9/1985 | Zadiraka | 241/30 |
| 4,602,744 A | | 7/1986 | Williams | |
| 4,640,204 A | | 2/1987 | Williams | |
| 4,830,290 A | | 5/1989 | Williams | |
| 5,048,761 A | * | 9/1991 | Kim | 110/265 |
| 5,095,827 A | | 3/1992 | Williams | |
| 5,330,110 A | | 7/1994 | Williams | |
| 5,383,612 A | | 1/1995 | Williams | |
| 5,611,494 A | | 3/1997 | Williams | |
| 5,839,673 A | | 11/1998 | Williams | |

OTHER PUBLICATIONS

RTP Corp. Application Note: Effective, Economical Boiler Control With A Redundant Hybrid Control System (HCS); 8 pgs.

Williams Direct Fired Systems; 11 pgs.

Bulletin: Williams–Fluid Bed Roller Mill Systems; 6 pgs.

Bulletin: Williams–Impact Dryer Mill; 4 pgs.

Bulletin 930R: Williams–Direct Fired Systems; 4 pgs.

* cited by examiner

*Primary Examiner*—John M. Husar
(74) *Attorney, Agent, or Firm*—Polster, Lieder, Woodruff & Lucchesi, L.C.

(57) ABSTRACT

A closed loop control system for monitoring and regulating operation of a grinding mill to reduce material in quantity to exactly match a processor material demand. The control system regulates the operation of components of a grinding mill at in response to a linear interpolation of variables between predetermined set points stored in register tables, so as to substantially match the mill reducing capability with variations in the percentage of the processor material demand, without the need for operator intervention. Multiple register tables are provided to accommodate different feed materials or blends, and an operational history record is maintained to allow for reconstruction of events leading to any component failures. Air supplied through the grinding mill for transporting the ground material to the process is regulated to a substantially constant ratio of air to material from a minimum air velocity which maintains the ground material moving in the air stream, while the pressure differential across the grinding mill between its air supply and outlet is monitored for detecting abnormal changed in the differential pressure as a safety net.

11 Claims, 5 Drawing Sheets

CONTROL LOGIC FOR USE IN CONTROLLING GRINDING MILL SYSTEMS

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

The present invention is directed to a closed loop control apparatus and method for controlling, without operator input, the operation of a grinding mill system where its output or sizing (grind) is connected to a process such that a process flow requirement can be matched by the output at a substantially constant level.

In the past, material feeders connected to grinding mills, such as roller mills, have .been traditionally controlled by measuring one or more variables, such as the relative pressure differential across the roller mill, and using the differential as a target control means for the feeder to the roller mill. An example of such prior art is found in U.S. Pat. No. 4,602,744 to Williams for a "Method of Controlling A Grinding Roller Mill" which monitors the differential pressure as a safety net for modulating the rate of fuel feed into a grinding mill with notice to an operator when the system needs to be adjusted either by altering the material feed rate, synchronizing the feed rate or grinding capabilities, by altering the centrifugal crushing force by changing the mill speed, thereby yielding a substantially constant material flow to an associated burner receiving the ground fuel.

A similar control system can be found in U.S. Pat. No. 5,611,494 to Williams for a "Isolated Intelligent And Interrelated Control System With Manual Substitution" which discloses a boiler fuel distribution control system in which a boiler fuel demand signal is employed to regulate isolated control components to control the rate of grinding of fuel within predetermined limits of air supply. The grinding of the fuel in the '494 Williams patent is accomplished at a desired mill grinding speed and within a fluid bed differential pressure across the grinding mill to maintain a supply of fuel adequate to keep up the desired boiler burning rate of solid fuel. The system of the '494 Williams patent further provides for temporary manual adjustment to the individual isolated control components in the event of a fault in the automated control circuits of the system.

These known examples of prior art are suitable for use with direct fired boilers systems where service personnel or operators are standing by on a continual basis to either respond to a signal requesting a change in the fuel feed rate, or to take over manual control of a component in the event of automatic controller failure. Accordingly, it has come to be desirous to have a closed loop feedback control system implemented in software which can be readily adapted to regulate the rate of a material flow through a wide variety of grinder / processor systems, and which does not rely on the presence of an operator to change settings or manually control individual components, and which can automatically compensate for work index, guidability changes, moisture changes, different feed materials, or fineness of grinds by adjusting the operational parameters automatically for the remaining components and control value settings.

BRIEF SUMMARY OF THE INVENTION

Briefly stated, in its broad aspect the system of the present invention includes a control processor configured with software to monitor a number of important variables for the regulation or flow of the material feed to a grinding mill system, so as to maintain or match the output flow requirements from an associated process by matched rate or desired fineness. Monitored variables include mill speed, mill differential pressure, spinner speed, component motor current draw, air flow, and air temperature. The system software is configured to linearly interpolate variables between predetermined set points for the monitored variables. The predetermined set points are stored in register tables, and may be altered by an operator from a remote location, or in response to a change in the desired materials or fineness product. In the event a variational change is detected in one or more monitored variables, the system calculates one or more new variable setting, and makes the appropriate adjustments without the need for operator intervention.

In addition to providing a control processor with monitoring software, the system of the present invention is configured to track the variable inputs over time, maintaining at least one log which may be recalled in the event of a system or component failure. Furthermore, the system may be accessed from a remote location to allow for monitoring and for the alteration of the predetermined set points of individual variables, the rate at which the system samples and records the variable data, and the speed with which alterations occur.

The present embodiment additionally includes a method of operation which is set forth in more detail in the following description. The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates-the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
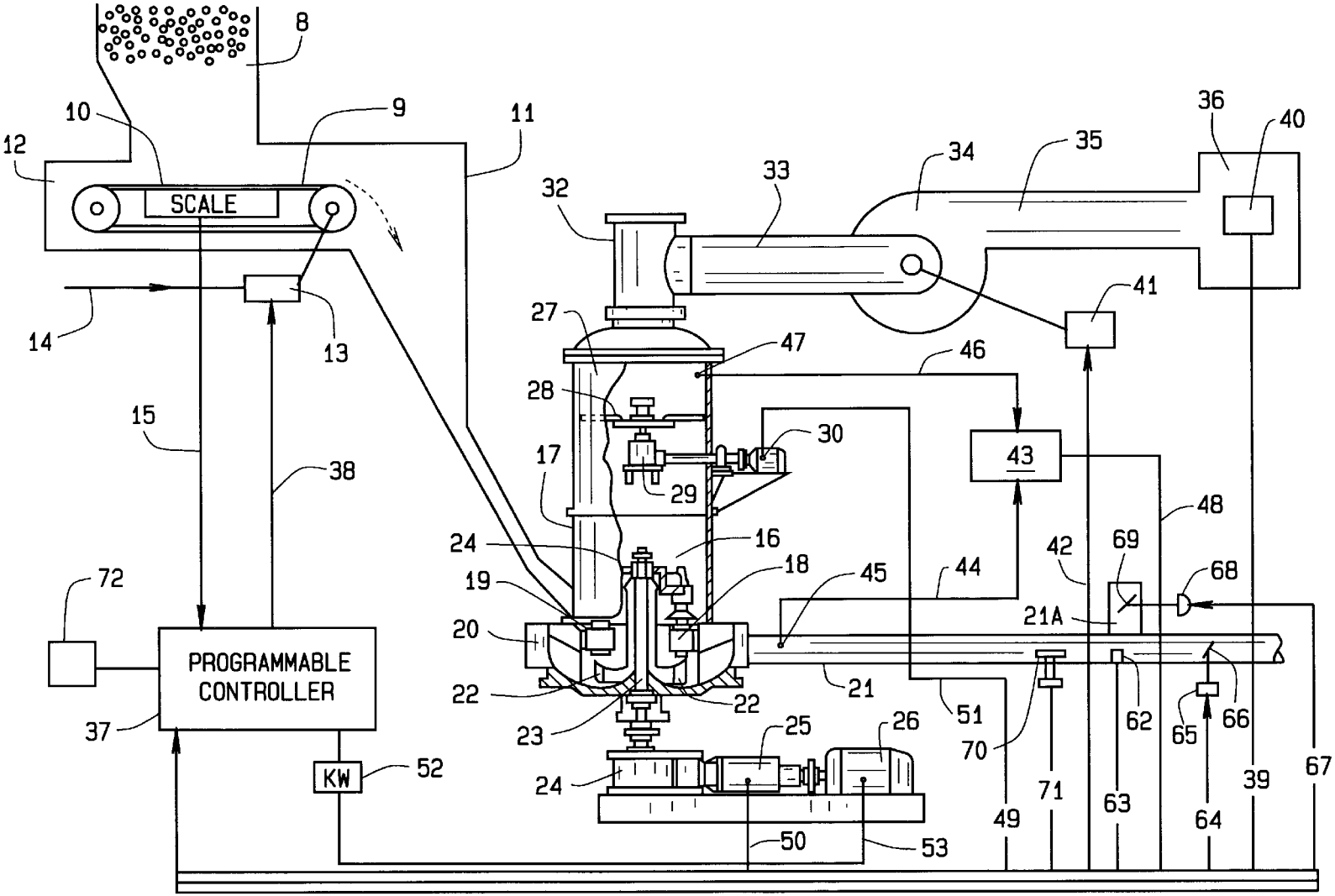
FIG. 1 is a schematic and partial sectional view of a grinding mill and separator for use with the present invention.

Turning now to FIG. 1, it can be appreciated that the source of material, which may be a fuel such as coal, or a mixture like coal/coke or coal/limestone, or any other material or mixture to be ground, is received in hopper 8 so it may be directed onto a conveyor feeder in the form of a weight belt 9 which is equipped with a weighing scale 10 for measuring the material quantity in unit time which will then be delivered by the weight belt 9 into the chute 11. Alternate types of feeders may be utilized, for example, volumetric feeders, screw or rotary feeders, and vibratory feeders may be employed within the scope of the invention. The chute 11 is part of a general housing 12 to confine dust and similar material so that it will not be released into the ambient atmosphere. The weight belt 9 is driven by a suitable motor 13 having an electric power source 14, and the weighing scale 10 produces a signal at lead 15 which will be more fully referred to hereinafter. The material delivered into the chute 11 enters the grinding chamber 16 of an air swept fluid bed vertical shaft grinding mill 17 where it is reduced in size. The crushing or grinding chamber 16 of the mill 17 is formed with inlet openings to a wind box 20 having an air inlet 21 for introducing air into the lower portion of the crushing chamber so that the sweep of the air and the action of plows 22 driven by the vertical shaft 23 from a suitable head assembly 24 will constantly stir and lift the material into the grinding elements 18 and 19. The drive mechanism for the vertical shaft 23 includes a gear box 24 having a variable speed motor 25 disposed between the gear box 24 and the driving motor 26.

The ground material is air swept upwardly through the grinding chamber 16 into a spinner separator or classifier 27 which embodies rotating blades 28 operable on a shaft driven through a gear box 29. The gear box 29 receives its driving energy from a variable direct drive electric motor 30. The centrifugal action of the blades 28 in the spinner separator acts on the material projected upwardly into the blades 28 so that the oversized material will be centrifugally forced outwardly against the walls of the separator housing to fall back into the grinding chamber for further reduction. The material which is not returned to the grinding chamber 16 will pass outwardly through the outlet 32 and into conduit 33 connected into the suction side of blower 34. The outlet conduit 35 from the blower 34 delivers the air transported material into a suitable collection device or processor, such as a burner, indicated generally at 36 wherein the material is either stored, further processed, or consumed and used to produce a desired output product, such as steam or ash. In the view of FIG. 1, the blower 34 is disposed on the outlet side of the mill, but it may just as well be located in conduit 21 to positively supply air to the mill.

It is known that there is an optimum material bed depth for efficient grinding so as to result in a desired reduction of the material. If the material bed depth is too thin to result in efficient crushing or breaking of the material particles, there is a chance that the grinding components 18 and 19 may contact each other, resulting in a loss of capacity in the grinding of the material and a decrease in the efficiency of energy usage. Alternatively, if the material bed depth is to deep for maximizing the forces imparted to grind the material, the result is a low energy efficiency and a reduction in grinding capacity. In practice, it is necessary for the apparatus to run under optimum conditions for maximum production of ground material at the most efficient use of energy. Accordingly, the controller 37 is operated to sample the signal inputs at selected intervals and to determine if the mill 17 is operating efficiently at an optimum material bed depth to produce the ground material at the rate demanded by the process and received from the feeder weight belt 9.

Figure 2:
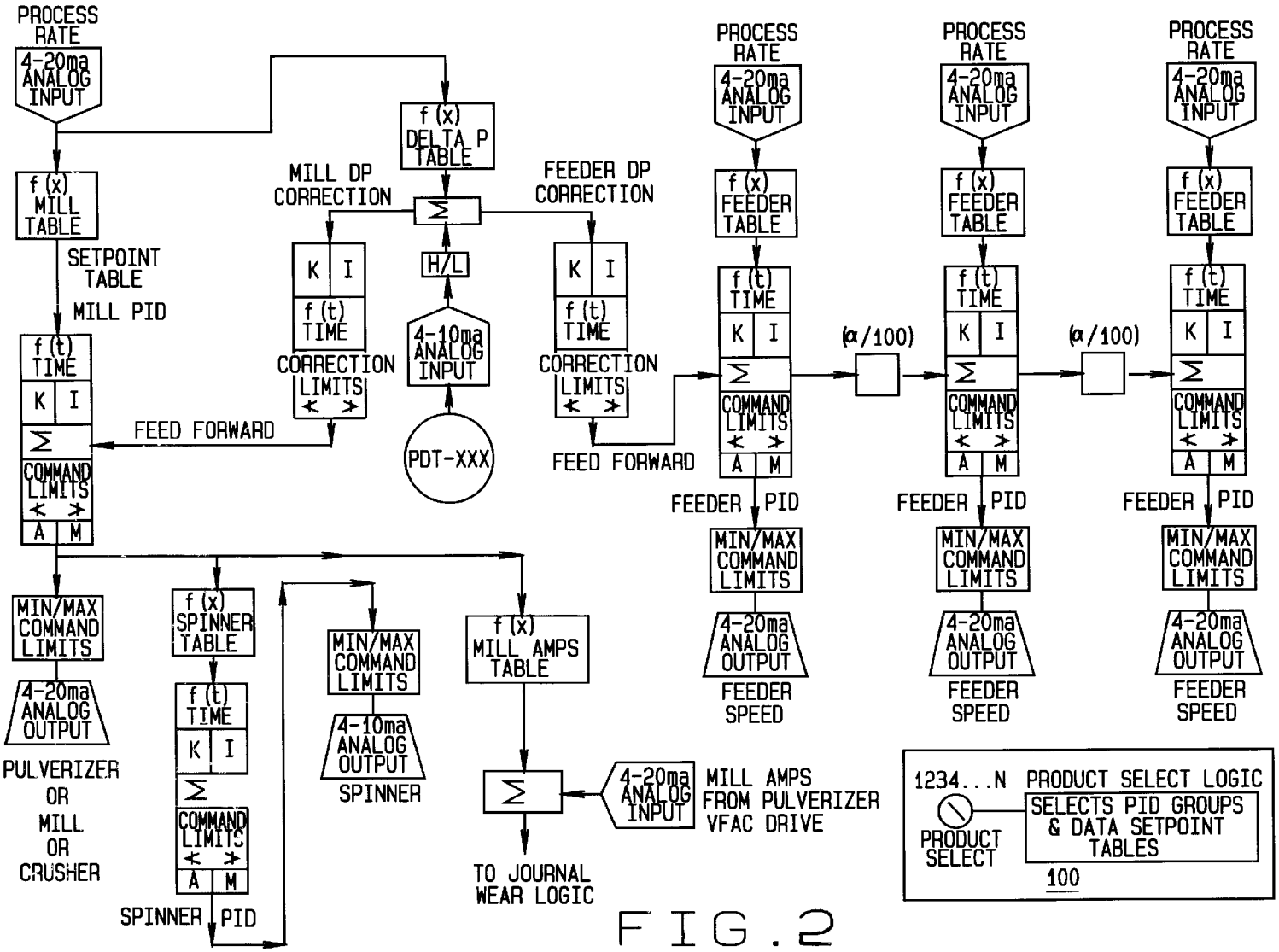
FIG. 2 is an analog control logic module layout for the apparatus of the present invention.

The initial settings on the controller 37 are operator selected based upon the desired product fineness and rate. As seen in FIG. 2, a product select switch 100 selects groups of data set points and tables for use with the apparatus to result in an optimum material processing to yield the desired product fineness and rate. While only four settings are illustrated in FIG. 2, those of ordinary skill in the art will recognize that any number of settings for different desired products may be included in the scope of the present invention. Upon the selection of a desired product, the controller 37 receives an analog product demand rate signal, typically in the range of 4–20mA from the processor, which then utilizes the set point lookup tables to interpolate the corresponding operating parameters for each component based upon the received product rate signal. For example, upon receiving an initial product rate signal, the air damper or fan speed is set by the controller 37 to an initial setting, the ideal mill temperature is identified, an air heater or hot air damper setting is identified, the mill speed is set, and the feeder speed is set. Additional controlled elements may be added for specific operations and which respond to the controller 37 by establishing initial operating conditions upon receipt of an initial product rate signal therefrom.

Referring to FIGS. 1 and 2, the controller 37 performs its function in response to signals transmitted by lead 39 from a material demand responsive transmitter 40 located at the material processor 36. The controller 37 sends a product rate signal to the motor 13 at feeder weight belt. 9 through lead 38 and receives back an analog signal in the range of 4–20 mA through lead 15 that the conveyor motor is at a required speed to deliver material at a pounds per hour rate which is calculated by the controller 37 from a set point table so as to exactly match the selected process demand.

In response to the startup and operation of the mill feeder weight belt 9, the spinner separator or classifier 27 begins operation, at a speed which is determined based upon the speed of the feeder weight belt 9, as seen in FIG. 2. Once operational, an analog signal is received back at the controller 37 from the spinner 27, indicating the spinner operating speed.

Optionally, the startup and operational speed of the mill feeder weight belt 9, together with an analog signals representing the observed current draw from the mill grinder drive motor 26, may be further utilized by the controller 37 to determine the wear rate of grinding components 18 and 19.

Figure 3:
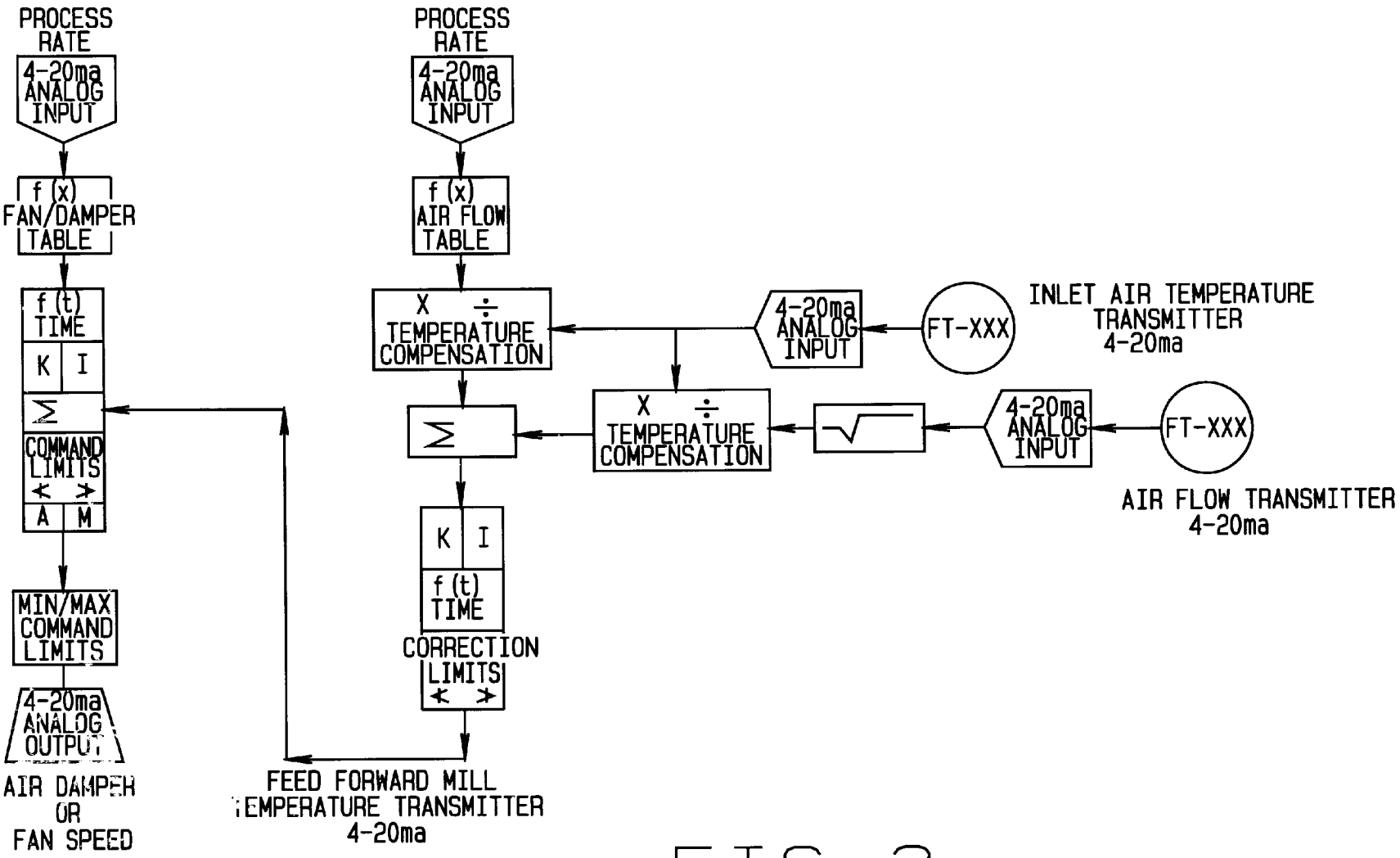
FIG. 3 is an additional analog control logic module layout for the apparatus of the present invention.

As illustrated in the control logic diagram of FIG. 3, the controller 37 is effective to regulate the flow of the incoming air in conduit 21 in response to receiving signals from an air flow transmitter 70, preferably a differential pressure across a venturi, and the inlet air temperature transmitting device 62, each generating an analog signal over leads 71 and 63, respectively. The controller 37 determines an initial air flow rate for a given product rate signal by table lookup. Additionally, an initial fan speed or air damper setting is similarly determined by the controller 37. The signals from the inlet air temperature transmitter and the air flow transmitter are then utilized by the controller 37 to alter the air damper setting or fan speed, compensating for variations in air flow, temperature, or pressure, which the controller 37 is able to modulate by transmitting a signal in lead 64 to the motor 65 for damper or fan 66 in the hot air inlet, and by a signal in lead 67 to the motor 68 for damper or fan 69 in the inlet 21A for tempering air. An analog output signal in the range of 4–20 mA from the air damper or fan, representative of the current setting is then generated and returned to the controller 37. By thus regulating the air flow and temperature in the grinding mill, the controller 37 can control the blower 34 to deliver air at an exact flow rate required by the process flow requirements.

Figure 4:
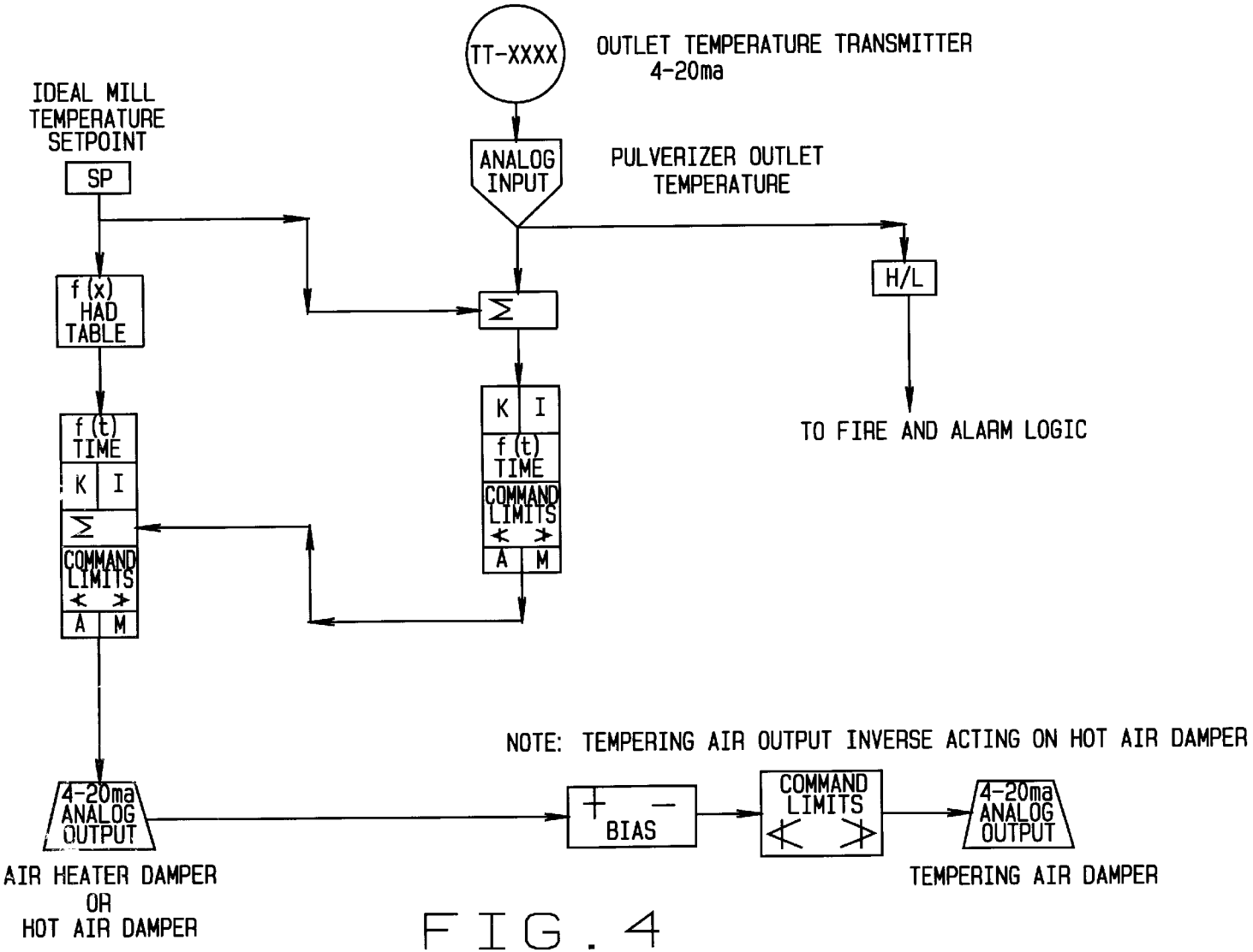
FIG. 4 is an additional analog control logic module layout for the apparatus of the present invention.

In order to dry or reduce the moisture content of the material being delivered to the processor, it is desired that the grinding mill have an ideal operating temperature, as measured at the grinder outlet 32. The initial mill temperature set point is fixed and maintained by the controller 37, receiving as input, an outlet temperature in the form of an analog signal ranging from 4–20 mA from an outlet temperature sensor. As seen in FIG. 4, if the outlet temperature is observed to exceed a maximum or minimum, suitable alarm logic routines are triggered in the controller 37, and a shutdown can occur without operator intervention. During normal operation, the analog signal from the outlet temperature sensor is utilized by the controller 37 to regulate an air heater damper or hot air damper for controlling the flow of heated air into the grinder. An output analog signal generated by the air heater damper or hot air damper is returned to the inlet air damper or fan motor 68, thereby providing an feed forward loop, and aiding in the temperature regulation of the mill.

It is also necessary that the controller 37 respond to information concerning the differential pressure across the mill and classifier. This is accomplished by manometer device 43 which receives signals by lead 44 from a pressure responsive device 45 in the air inlet 1 and by lead 46 from a pressure responsive device 47 in the classifier 27. The manometer device 43 responds to the difference in the signals received from leads 44 and 46 and generates a differential pressure signal in lead 48 which is processed by the controller 37 in a manner to be described. This loop is used to bias the mill speed signal for changes in material grindability.

It can be seen in FIG. 1 that the controller 37 is connected by lead 49 to a branch lead 50 and a branch lead 51, which leads are connected to the mill drive clutch 25 and the spinner clutch 31 respectively so these devices can be operated in inverse speed ranges. Also, it is seen in FIG. 1 that the controller is provided with a kilowatt hour meter 52 connected by lead 53 to the mill driving motor 26 for measuring the power consumption of that motor.

Figure 5:
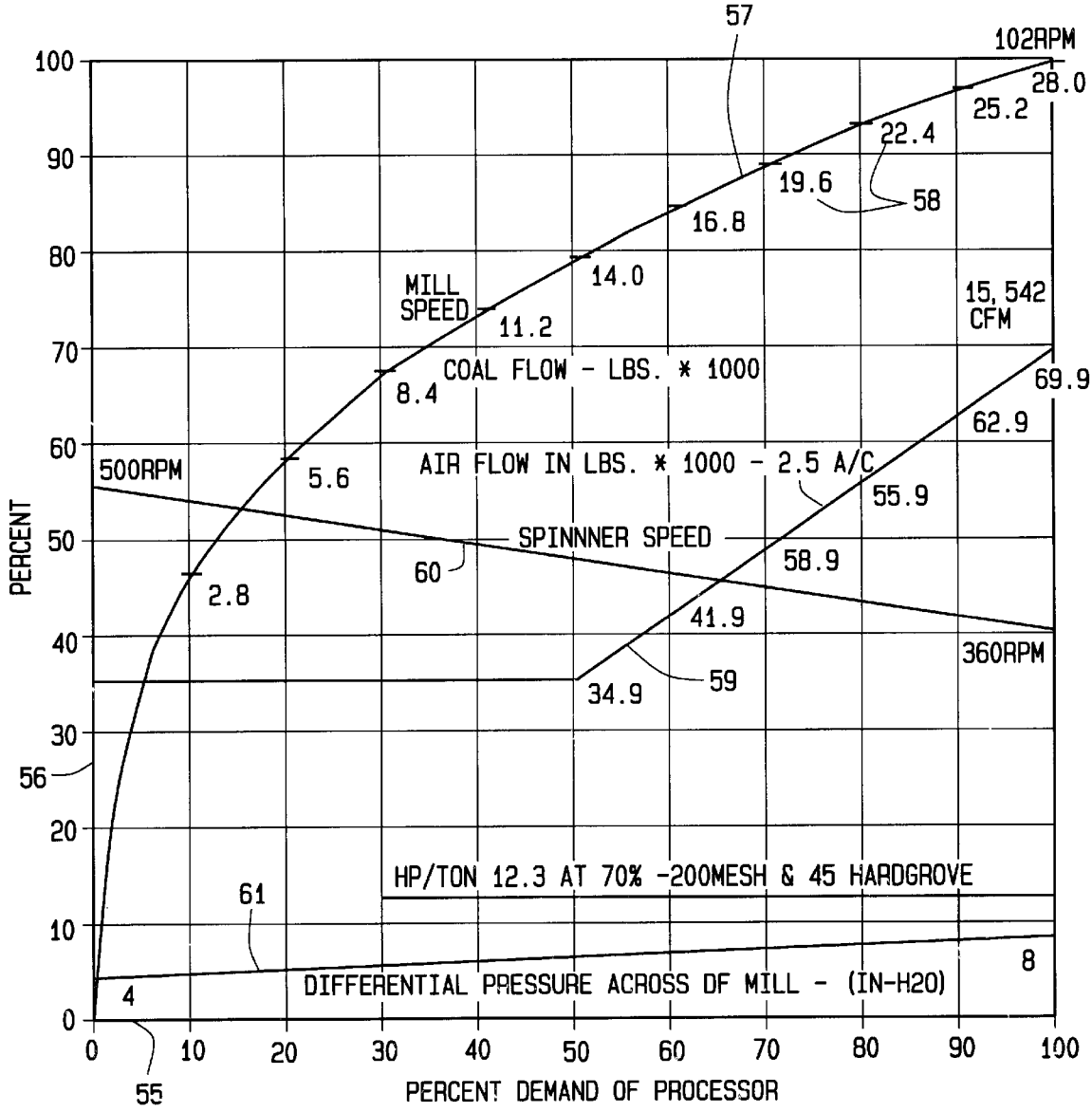
FIG. 5 is a graph illustrating certain desired relationships between process requirements and mill speed, classifier speed, and differential pressure across the mill and classifier.

Turning now to FIG. 5, the graph illustrates the important relationships between the several components of the apparatus which need to be accounted for to make the system of this invention attain its objectives. The graph sets forth along its abscissa 55 the percentage of process demand for material to produce the process flow called for. The ordinate 56 sets forth the percent of mill speed for grinding the material supplied from the feeder 9. The mill grinding speed curve 57 is translated into its ability to grind a desired particle size and deliver into the conduit 33 quantities of the material expressed by the values 58 along the curve 57 in pounds of material increased by a factor of 1000 for a typical system. Thus at a process demand of 70% of full capacity, the feeder 9 must deliver 19.6×1000 pounds of material to be ground in the mill 17 a mill speed about 89% of full speed. At the same time, the blower 34 must be delivering air at the ratio of 2.5 pounds of air per pound of material which is illustrated by the curve 59 into 48,900 pounds of air per hour, or about 10,866 SCFM. In this relationship the mill speed varies as the third power of the percentage of the process demand for the material material. Concurrently, the spinner 27 will operate at a speed of about 45% of the spinner full speed, 500 RPM, as is seen on curve 60 to maintain constant product particle size.

During the operation of the foregoing system, and with the mill being able to grind the material efficiently and within the processor demand and the ability of the feeder to meet the processor demand, the controller 37 will merely note that the differential pressure, or ΔP, is at a value less than that expressed along the curve 61, for the corresponding processor demand. However should a malfunction occur, such as a grinding element 18 experiencing a bearing failure or a more likely change in work index or grindability of the feed material will result in a substantial drop in grinding capability, the ΔP value across the mill and spinner will begin to climb due to the mismatch between the grinding rate and the feed rate. The mismatch produces a change in the ΔP value from the permissible readings of curve 61. When the ΔP value rises above the curve 61 immediately, the controller 37 will operate a signal 72 to bias the mill speed settings. The monitoring of the ΔP values by the controller 37 is relied upon as a safety net to safeguard the system by signaling a too high ΔP and avoid costly down time due to blockage, or to indicate that the supply of material form the feeder 9 to the mill has built up in a material bed that is excessively thick which the mill cannot grind efficiently or fast enough. The excess material in the mill bed will cause the controller to either (a) speed up the mill, or (b) as a backup slow down the feeder.

The foregoing details of the disclosed embodiment of the present invention is concerned with a method of controlling the operation of a grinding mill which is connected with a process so that the process flow produced by the process will match the demand by properly regulating the supply of material to the grinding mill system so that the output will supply the amount of material demanded by the process flow. In such a method, it is important to be able to adjust the rate of feed of the material and airflow to the grinding mill such that it can efficiently grind and reduce the material without operating in a condition where the bed of material is either too thin or too deep.

In its broad aspects, the method includes feeding material to the inlet of a grinding mill in such quantities as to exactly match the process material demand, driving the grinding mill at a speed which varies as the third power of the percentages of processor demand for material so as to substantially match the mill grinding capabilities with variations in the percentage of the process material demand. The method additionally involves supplying air through the grinding mill for transporting the ground material to the processor at a substantially constant ratio of air to material for a minimum air velocity which maintains the ground material moving in the air stream, and the monitoring of the pressure differential across the grinding mill between its air supply and its air transported outlet to detect abnormal changes, and to make adjustments automatically. Each component of the grinding mill system is regulated by a controller in a closed loop system to respond to changes in the continuous material demand signal for material from the processor, as is indicated by linear interpretation of operating parameters from a table of predetermined operational set points by the regulating controller, in combination with feedback signals from the remaining components of the grinding mill. The feedback signals, material demand signal and current operational settings are periodically stored electronically for future reference. The periodic storage of the signals and settings on a hard-drive or other suitable electronic storage medium to provide an operational history is preferably carried out every two minutes, for a three-month cycle, after which the stored data is replaced with new data. Those of ordinary, skill in the art will recognize that the storage periods may be changed to record data on a more frequent basis, or slower, during periods of inactivity.

Variation in operation of one grinding mill component from a desired operational setting, for example inlet air flow, is detected at the regulating controller by a continuous feedback signal from each grinding mill component, and results in the automatic alteration of the operational settings of other components of the mill by the regulating controller to maintain the desired material flow rate to the processor. In the event of a failure of a component, the stored signals and settings data corresponding to a period of time prior the component failure may be retrieved from the electronic storage device and analyzed to determine a cause or sequence of events leading to the failure of the component.

In the foregoing method it is important to utilize the differential pressure across the grinding mill and its spinner separator independently relative to the processor demand as a safety net so as to be able to monitor the condition of the material fluid bed in the grinding chamber, whereby the development of a improper depth of material in the grinding mill can be indicated merely by detecting significant changes in the pressure differential for any given processor demand.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. An apparatus for controlling the supply of material to a processor that emits a material demand signal, the apparatus comprising:

a material grinding and material particle sizing mill connected in material delivery responsive association to a processor emitting a material demand signal, said grinding and sizing mill including a plurality of controlled components;

a control microprocessor responsive to, and operatively connected to, said material demand signal and to each of said plurality of controlled components, said control microprocessor configured to interpolate at least one operational parameter for each of said plurality of controlled components based upon said material demand signal and a plurality of feedback signals received from said plurality of controlled components to operate said grinding and sizing mill to deliver material for said processor, to grind the material, and to release material of a predetermined particle size to said processor from said grinder;

wherein said plurality of controlled components includes:

a mill conveyor drive motor, said drive motor actuating a material delivery system to deliver material to said mill for grinding;

a mill grinder motor, said grinder motor driving a grinder to receive said delivered material and to pulverize said received material;

a mill spinner motor, said spinner motor driving a centrifugal separator to classify pulverized material according to size;

a temperate air inlet regulator configured to regulate a flow of temperate air into said grinding mill; and a heated air inlet regulator configured to regulate a flow of heated air into said grinding mill.

2. An apparatus for controlling the supply of material to a processor that emits a material demand signal, the apparatus comprising:

a material grinding and material particle sizing mill connected in material delivery responsive association to a processor emitting a material demand signal, said grinding and sizing mill including a plurality of controlled components;

a control microprocessor responsive to, and operatively connected to, said material demand signal and to each of said plurality of controlled components, said control microprocessor configured to interpolate at least one operational parameter for each of said plurality of controlled components based upon said material demand signal and a plurality of feedback signals received from said plurality of controlled components to operate said grinding and sizing mill to deliver material for said processor, to grind the material, and to release material of a predetermined particle size to said processor from said grinder;

a differential pressure sensor configured to measure a differential pressure across said material grinding and material particle sizing mill, said differential pressure sensor configured to continuously emit a differential pressure analog signal; and said control microprocessor further responsive to said differential pressure analog signal to adjust said at least one interpolated operational parameter for at least one of said plurality of controlled components.

3. An apparatus for controlling the supply of material to a processor that emits a material demand signal, the apparatus comprising:

a material grinding and material particle sizing mill connected in material delivery responsive association to a processor emitting a material demand signal, said grinding and sizing mill including a plurality of controlled components;

a control microprocessor responsive to, and operatively connected to, said material demand signal and to each of said plurality of controlled components, said control microprocessor configured to interpolate at least one operational parameter for each of said plurality of controlled components based upon said material demand signal and a plurality of feedback signals received from said plurality of controlled components to operate said grinding and sizing mill to deliver material for said processor, to grind the material, and to release material of a predetermined particle size to said processor from said grinder;

an inlet air temperature sensor configured to measure air temperature at an inlet to said material grinding and material particle sizing mill, said inlet air temperature sensor configured to continuously emit an inlet air temperature analog signal; and said control microprocessor further responsive to said inlet air temperature analog signal to adjust said at least one interpolated operational parameter for at least one of said plurality of controlled components.

4. An apparatus for controlling the supply of material to a processor that emits a material demand signal, the apparatus comprising:

a material grinding and material particle sizing mill connected in material delivery responsive association to a processor emitting a material demand signal, said grinding and sizing mill including a plurality of controlled components;

a control microprocessor responsive to, and operatively connected to, said material demand signal and to each of said plurality of controlled components, said control microprocessor configured to interpolate at least one operational parameter for each of said plurality of controlled components based upon said material demand signal and a plurality of feedback signals received from said plurality of controlled components to operate said grinding and sizing mill to deliver material for said processor, to grind the material, and to release material of a predetermined particle size to said processor from said grinder;

an outlet air temperature sensor configured to measure air temperature at an outlet to said material grinding and material particle sizing mill, said outlet air temperature sensor configured to continuously emit a outlet air temperature analog signal; and said control microprocessor further responsive to said outlet air temperature analog signal to adjust said at least one interpolated operational parameter for at least one of said plurality of controlled components.

5. An apparatus for controlling the supply of material to a processor that emits a material demand signal, the apparatus comprising:

a material grinding and material particle sizing mill connected in material delivery responsive association to a processor emitting a material demand signal, said grinding and sizing mill including a plurality of controlled components;

a control microprocessor responsive to, and operatively connected to, said material demand signal and lo each of said plurality of controlled components, said control microprocessor configured to interpolate at least one operational parameter for each of said plurality of controlled components based upon said material demand signal and a plurality of feedback signals received from said plurality of controlled components to operate said grinding and sizing mill to deliver material for said processor, to grind the material, and to release material of a predetermined particle size to said processor from said grinder;

wherein said control microprocessor is configured to periodically store said material demand signal, said interpolated operational parameters, and said plurality of feedback signals to provide an operational history for a predetermined period of time.

6. A method for operating a variable speed material grinder mill having a regulating controller for regulating operation of a plurality of mill components, said grinder mill being connected to a processor for consuming ground material, said method comprising the steps of:

identifying to said regulating controller a type of material to be ground;

responsive to said identification, selecting within said regulating controller a set of data points for a desired operational range for each of said plurality of mill components, each said desired operational range associated with said type of,material to be ground;

continuously supplying a material demand signal from said processor to said regulating controller;

responsive to said material demand signal, said regulating controller interpolating an initial operating condition for each of said plurality of mill components from said respective sets of data points;

operating each of said plurality of mill components at said initial operating condition to grind said material and to supply said ground material to said processor, each of said plurality of mill components continuously supplying a feedback signal to said regulating controller;

responsive to said continuous feedback signal and to said continuous material demand signal, said regulating controller continually altering an operating condition for one or more of said plurality of mill components as required to maintain operation of each of said plurality of mill components within said desired operational range.

7. The method of claim 6 for operating a variable speed material grinder mill having a regulating controller for regulating operation of a plurality of mill components further comprising the steps of:

measuring a differential pressure across said material grinding mill input and output;

continuously signaling said measured differential pressure to said regulating controller; and responsive additionally to said continuous differential pressure signals, said regulating controller continually altering an operating condition for one or more of said plurality of mill components as required to maintain operation of each of said plurality of mill components within said desired operational range.

8. The method of claim 7 wherein said plurality of mill components includes a mill feeder and wherein said operating condition for said mill feeder is a desired material capacity.

9. The method of claim 7 wherein said plurality of mill components includes an air blower configured to deliver air to said mill and wherein said operating condition for said air blower is a desired volume per unit time value.

10. The method of claim 7, wherein said plurality of mill components includes a centrifugal particle separator and wherein an operating condition for said centrifugal particle separator is a rotational speed value.

11. The method of claim 6 for operating a variable speed material grinder mill further including the step of periodically storing said continuous feedback signal, said continuous material demand signal, and said operating conditions for each of said plurality of mill components to compile an operational history of the grinder mill operation for a predetermined period of time.

* * * * *

UNITED STATES PATENT AND TRADEMARK OFFICE

CERTIFICATE OF CORRECTION

PATENT NO. : 6,467,707 B1
DATED : October 22, 2002
INVENTOR(S) : Robert M. Williams, Jr.

It is certified that error appears in the above-identified patent and that said Letters Patent is hereby corrected as shown below:

Title page,
Item [73], Assignee should be deleted, as the patent has not been assigned.

Signed and Sealed this

Fourth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,467,707 B1
DATED : October 22, 2002
INVENTOR(S) : Robert M. Williams It is certified that error appears in the above-identified patent and that said Letters Patent is hereby corrected as shown below:

Title page,
Item [*] Notice: Subject to any disclaimer, the term of this patent is extended or adjusted under 35 U.S.C. 154(b) by 182 days. --

Signed and Sealed this

First Day of April, 2003

JAMES E. ROGAN
*Director of the United States Patent and Trademark Office*